US006242372B1

(12) United States Patent
Schwekutsch

(10) Patent No.: US 6,242,372 B1
(45) **Date of Patent: *Jun. 5, 2001**

(54) NON-WOVEN COMPOSITE, A PROCESS FOR ITS PRODUCTION AND ITS USE

(75) Inventor: Siegfried Schwekutsch, Feldkirchen-Westerham (DE)

(73) Assignee: Kufner Textilwerke GmbH, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/778,808

(22) Filed: Jan. 3, 1997

(30) Foreign Application Priority Data

Sep. 10, 1996 (DE) ..... 196 36 722

(51) Int. Cl.[7] ..... A63H 5/00
(52) U.S. Cl. ..... 442/278; 442/281; 442/319
(58) Field of Search ..... 442/278, 281, 442/319

(56) References Cited

U.S. PATENT DOCUMENTS 5,241,709 9/1993 Kufner et al. .

FOREIGN PATENT DOCUMENTS

| | | |
|---|---|---|
| 17 80 605 | 9/1958 | (DE) . |
| 2332492 | 1/1975 | (DE) . |
| 41 16 569 A1 | 5/1991 | (DE) . |
| 44 08 813 C1 | 3/1994 | (DE) . |
| 0080946 | 6/1983 | (EP) . |
| 0369046 | 5/1990 | (EP) . |
| 0387117 | 9/1990 | (EP) . |
| 0 514 563 A1 | 11/1992 | (EP) . |
| 0730056 | 9/1996 | (EP) . |
| 1095281 | 12/1967 | (GB) . |
| 1335430 | 10/1973 | (GB) . |

*Primary Examiner*—Elizabeth M. Cole
*Assistant Examiner*—Arti R. Singh
(74) *Attorney, Agent, or Firm*—Scully, Scott, Murphy & Presser

(57) ABSTRACT

This invention concerns a non-woven composite, comprising a fabric or knitted fabric and at least one layer of a non-woven fabric, in which the fabric or the knitted fabric and the non-woven layer(s) are bonded with each other. This invention also describes a process for the production of this non-woven composite as well as its use as a stiffening lining, in particular a patch lining, for example for the strengthening and padding of sleeves in the shoulder bone zone, for strengthening in the waist band zone or of hats and/or caps.

18 Claims, No Drawings

NON-WOVEN COMPOSITE, A PROCESS FOR ITS PRODUCTION AND ITS USE

This invention concerns a non-woven composite of a fabric or a knitted fabric and at least one layer of a non-woven fabric. This invention also concerns a process for the production of such a non-woven composite, as well as its use as a stiffening lining, in particular a patch lining.

Such linings have been worked in for many years past to strengthen articles of clothing, in particular in ready to wear clothing for ladies and gentlemen. Depending on the processing method, they can extend, for example, over the entire front portion of a jacket or they are processed only as so-called chest canvas. The stiffening linings should provide the front portion of the article of clothing with form stability, and in addition a good recovery and/or snap back capability is expected from the stiffening linings which are used respectively.

Until now, conventionally special fabrics, usually calico fabrics have been used on the market, and these fabrics have a weight range from about 120 to 260 g/m$^2$. Corresponding knitted fabrics are also to be found in individual cases in the market.

In order to achieve the desired good recovery capability, above all in the weft direction, in these fabrics and knitted fabrics use is preferably made in the weft of coarse yarns, which are mainly spun in the semiworsted yarn process. The fiber components which are used are primarily of natural origin. In particular, animal hairs are used in the weft, in which depending on the type of lining, these yarns are inserted in the fabric in the weft change with pure viscose yarns, wool yarns or mixtures of them. The animal hairs can also be spun in combination with coarse viscose fibers. For special preference, hairs of african goats or yak hairs are also used. Use is also made gladly and especially frequently of horse hairs, in particular twists of these hairs. But the disadvantage here is that these horse hairs are relatively expensive.

The use of animal hairs has further substantial disadvantages. Thus animal hairs have to be subjected to substantial cleaning processes, which leads to the fact that these processes are very laborious and consequently are also costly. In addition, the use of animal hairs is disadvantageous, because frequently they may initiate allergies among the workers who have to carry out the cleaning of these animal hairs. In addition, the yarns which are produced from animal hairs or mixtures thereof are subject to very strong fineness fluctuations (number fluctuations), which in turn brings with it weight fluctuations in the finished product.

In addition, multicomponent yarns, so-called core yarns, are used in the weft, which for some time past have also been produced in the Dref process. These yarns also contain as the resilient component animal hairs or preferably synthetic monofilaments and/or multifilaments. Characteristic is the structure of one or more resilient components, as well as of coat fibers.

Above all, in the case of yarns which contain a synthetic monofilament, there are always problems of the type in which the monofilament in these yarns tends to displacement against the coat fibers. Then on the cut edges of the ready to wear reinforcement lining, the monofilaments emerge and on the finished ready to wear part they can even pierce through the outer fabric.

In all the stiffening linings of this type, additional linings are still needed in the clothing in order to achieve the desired stiffening effect. But the processing of these linings and of the additional linings necessitates high costs for production and materials, as well as particularly great care when producing the patch linings, their positioning and clean edge stitching. The patch linings and the additional lining have to be positioned exactly to a millimeter and they are combined by costly sewing processes to form a total patch.

Another type of patch lining is described in EP 0 514 563. This concerns a warp-knitted fabric, which is provided in the weft with resilient threads of core yarns. This warp-knitted fabric is connected with a basic non-woven fabric on a warp knitting machine. The resultant patch lining is used as a supplementary reinforcement lining for the actual patch lining for the protection, for example, of shoulder, axilla and arm hole zones. But due to the method of production, the strength and the volume of the basic non-woven fabric is extremely limited, because during the loop formation, the warp yarns strongly tie together the basic non-woven fabric, and therefore in the warp direction along the needle wales, constrictions are formed in the basic non-woven fabric, which in the case of sensitive outer fabrics show through the outer fabric.

Therefore the present invention is based on the technical problem of developing a non-woven composite which on the one hand can be produced economically and on the other does not have the disadvantages of the above-named patch linings, and is also simple to process in the making up. In particular, the non-woven composite should not show through the outer fabric of articles of clothing.

In order to solve this problem, in accordance with the invention a non-woven composite of the type named initially is suggested, in which the fabric or the knitted fabric and the layer(s) of non-woven fabric are bonded with each other. The fabric or knitted fabric can be bonded on one side or also on the upper and lower sides respectively with a layer of non-woven fabric.

The recovery capability of the non-woven composite is achieved by a fabric or knitted fabric which provides resilience. The weft yarns of the fabric or knitted fabric are monofilaments or multifilaments or a combination of them. It is also possible that the monofilaments are twisted to form a multifilament yarn, which then forms the weft threads which provide resilience. The material from which the weft yarns are produced is preferably polyamide 6, polyamide 6,6, polyester or polypropylene or also mixtures of synthetic fibers. For example, the weft yarns can be monofilaments with a fiber diameter of 0.05 to 0.40 mm.

But it is also possible to use thread sequences with monofilaments and multifilaments as well as with conventional spun threads. Equally, as the weft yarns, multifilaments can be used which have a titer in the range from 400 to 2000 dtex.

In accordance with the invention it is also possible to bond the warp-knitted fabric which is known from EP-A-0 514 563 with at least one layer of a non-woven fabric, thus obtaining the new non-woven composite.

The warp yarns of the fabric or of the knitted fabric are preferably cotton, wool or other natural fibers or viscose, polyester, polyamide, polyacryl nitrile or polypropylene or mixtures thereof. Preferably the warp yarns have finenesses in the range from 25 to 400 dtex, preferably in the range from 100 to 400 dtex. Filament chains can also be used, wherein they may be textured in addition. When monofilaments are used as warp yarns, they can also have a fiber diameter of 0.05 to 0.40 mm, as in the case of the weft yarns described above. Naturally it is also possible to carry out twisting of a plurality of such monofilaments to form a multifilament which then constitutes the warp thread.

If a knitted fabric is used for the non-woven composite of this invention, preferably multifilaments are used in the chain having a fineness in the range from 25 to 400 detex.

The non-woven fabric which is used in accordance with the invention for the production of the non-woven composite can be a needle non-woven fabric, a water jet bonded, bonding agent bonded or a dot-welded non-woven fabric, a knitted non-woven fabric or a foam non-woven fabric. It is also possible to use a combination of these materials. The weight of the non-woven fabric is preferably in the range from 10 to 180 g/m$^2$.

Because of the structure of the non-woven composite of the plurality of layers which are bonded together, the disadvantages of the previously known lining types are avoided. The monofilaments which are used and which provide the resilience are firmly fixed by the bonding, and the ends of these monofilaments can no longer migrate into the made up portion. Thereby penetration through the outer fabric is prevented at the same time. Equally it can be avoided with certainty that constrictions are formed in the non-woven fabric, which show through the outer fabric.

In addition, it is possible by simple and economical ways and means to produce a non-woven composite as a stiffening lining with a soft and voluminous surface which is very simple to process during the make-up. The time-intensive and cost-intensive application of additional stiffening linings can therefore be omitted in the make-up.

The strength and the volume of the non-woven fabric which is applied on the fabric or knitted fabric can be varied almost at discretion, without constrictions being formed in the non-woven fabric, as was the case in the known composite. In addition, in accordance with the invention it is no longer necessary to use any animal hair, so that the disadvantages connected therewith no longer occur. In particular, the time-intensive cleaning of animal hairs and the allergenic stress on the personnel who come into contact with these hairs are omitted thereby.

Lastly, when using monofilaments in the weft, the use of core yarns can also be dispensed with, so that thereby the entire cost-intensive process of yarn production in this connection is omitted for the weft yarn.

It is also possible directly to coat the non-woven composite thus obtained in accordance with the known process with hot-melt adhesives, for example in raster form, in order thereby to make direct fixing on the outer fabric possible. The coating with hot-melt adhesives can be carried out in accordance with the previously conventional processes, in which apart from the single dot process, the so-called double dot process is also taken into consideration. As the hot-melt adhesives, the conventional adhesives are used here, wherein in particular preference is given to hot melt adhesives on the basis of polyamides in particular.

The non-woven composite in accordance with the invention can be used without an additional lining directly as a stiffening lining particularly in ready to wear clothing for men; but it is also possible to use the non-woven composite as an additional stiffening lining.

For example, the non-woven composite can also be used for strengthening and padding sleeves in the shoulder bone region. Equally, use as reinforcement is possible in the waist band zone or as reinforcement for hats and caps.

This invention also suggests a process for the production of such a non-woven composite, in which the upper and/or lower sides of the fabric or knitted fabric is bonded with a non-woven fabric. With special preference the bonding is carried out by calender-coating by means of hot-melt adhesives. The calender-coating is performed in accordance with processes known per se.

To explain this invention, some especially preferred embodiments of the non-woven composite in accordance with the invention will be disclosed below.

EXAMPLE 1

Non-Woven Laminate with Monofilament Fabric
Weft
Monofilament: polyester; diameter 0.22 mm
Binding: linen
Weft density: 110 weft/cm
Warp
Polester textured dtex 167 f32/l
Intake width 162.8
3910 threads
Weight of fabric: 103 g/m$^2$ Non-Woven Fabric Outer Fabric Side
Needle non-woven fabric 100% polyamide, coated with 12 g/m$^2$
Hot-melt adhesive based on polyamide
Weight 60 g/m$^2$ Non-Woven Fabric Backing Fabric Side
Thermobonding 100% polyester, coated with 10 g/m$^2$
Hot-melt adhesive based on polyamide
weight 25 g/m$^2$
Finished weight of the non-woven laminate: 210 g/m$^2$

EXAMPLE 2

Non-Woven Laminate with Monofilament Knitted Fabric
produced on a knitting machine with weft feed 24 E machine fineness
Weft
Monofilament: polyester, yarn diameter 0.22 mm
Weft density: 110 weft/cm
Warp
Polyamide-6,6 dtex 44fl3
Intake width 160 cm
1512 threads
Bonding: closed cloth open fringe
Weight of the knitted fabric: 70 g/m$^2$ Non-Woven Fabric Outer Fabric Side
Needle non-woven fabric 100% polyamide
Weight 60 g/m$^2$ Non-Woven Fabric Backing Fabric Side
Thermobonding 100% polyester
Weight: 25 g/m$^2$
Finished weight of the non-woven laminate: 177 g/m$^2$

EXAMPLE 3

Non-Woven Laminate Coated with Monofilament Knitted Fabric
produced on a knitting machine with weft feed 24E machine fineness
Weft
Monofilament: polyester, yarn diameter 0.22 mm
Weft density: 110 weft/cm
Warp
Textured polyester, intermingled-dtex 167 f32/1
Intake width 162.8
3910 threads Non-Woven Fabric Outer Fabric Side
Needle non-woven fabric 100% polyamide
Weight 60 g/m$^2$ Non-Woven Fabric Backing Fabric Side
Thermobonding 100% polyester
Weight 25 g/m$^2$
Finished weight of the non-woven laminate: 177 g/m$^2$

What is claimed is:

1. A non-woven composite comprising a woven fabric or a knitted fabric including weft yarns consisting essentially of multifilaments having a titer in the range of from 400 to 2000 dtex, and at least one layer of non-woven fabric, wherein the woven fabric or the knitted fabric and the at least one non-woven fabric layer are solely adhesively stuck with each other in the absence of said knitted or woven fabric and non-woven fabric layers being bonded together by a needing technique.

2. The non-woven composite according to claim 1, wherein said woven fabric or said knitted fabric has said at least one non-woven fabric layer on respectively the upper and the lower side thereof.

3. The non-woven composite according to claim 1, wherein a weft yarns of said knitted fabric or fabric are monofilaments or multifilaments or a combination thereof.

4. The non-woven composite according to claim 3, wherein said monofilaments are twisted to form a multifilament yarn.

5. The non-woven composite according to claim 3, wherein the weft yarns are polyamide-6, polyamide-6,6, polyester or polypropylene or mixtures of synthetic fibers.

6. The non-woven composite according to claim 3, wherein the weft is comprised of thread sequences with conventional spun yarns.

7. The non-woven composite according to claim 3, wherein said monofilaments have a fiber diameter of 0.05 to 0.40 mm.

8. The non-woven composite according to claim 1, wherein the warp yarns of said woven fabric or knitted fabric are cotton, wool or other natural fibers or viscose, polyester, polyamide, polyacrylnitrile or polypropylene or mixtures thereof.

9. The non-woven composite according to claim 1, wherein the warp yarns of said woven fabric or knitted fabric have finenesses in the range from 25 to 400 dtex.

10. The non-woven composite according to claim 9, wherein said finenesses are in the range from 100 to 400 dtex.

11. The non-woven composite according to claim 1, wherein the warp yarns of said woven fabric or knitted fabric are filament chains which are textured.

12. The non-woven composite according to claim 1 wherein warp yarns of said woven fabric or knitted fabric are monofilaments which have a fiber diameter of 0.05 to 0.40 mm.

13. The non-woven composite according to claim 12, wherein said monofilaments are twisted to form a multifilament.

14. The non-woven composite according to claim 13, wherein the warp yarns of said fabric consist of polyester multifilaments having a fineness of 0.25 to 400 dtex.

15. The non-woven fabric according to claim 1, wherein said non-woven fabric is a needle punched non-woven fabric, water jet bonded, binding agent bonded or dot welded non-woven fabric, a knitted fabric or a foamed woven fabric or a mixture thereof.

16. The non-woven composite according to claim 1, wherein said non-woven fabric has a weight in the range from 10 to 180 g/m$^2$.

17. A process for the production of a non-woven composite, comprising a woven fabric or a knitted fabric and at least one layer of a non-woven fabric, in which said non-woven fabric is adhesively stuck on the upper and/or lower side of the said woven fabric or knitted fabric.

18. The process according to claim 17, wherein the adhesive sticking is carried out by a calendar coating of hot melt adhesives.

* * * * *